US007789637B2

(12) United States Patent
Feng et al.

(10) Patent No.: US 7,789,637 B2
(45) Date of Patent: Sep. 7, 2010

(54) NUMERICALLY CONTROLLED RECIPROCATING SUBMERSIBLE PUMP APPARATUS

(76) Inventors: Chunguo Feng, Petroleum Machinery Factory Hangzhou Western Road, Yuhong Dis., Shenyang, Liaoning (CN) 110141; Zhongya Liu, No. 6 Jia 12, the 3rd Str., Zhangshi Developed Region, Yuhong Dis., Shenyang, Liaoning (CN) 110141

( * ) Notice: Subject to any disclaimer, the term of this patent is extended or adjusted under 35 U.S.C. 154(b) by 377 days.

(21) Appl. No.: 10/582,625

(22) PCT Filed: Sep. 13, 2005

(86) PCT No.: PCT/CN2005/001471

§ 371 (c)(1),
(2), (4) Date: Jun. 12, 2006

(87) PCT Pub. No.: WO2006/029570

PCT Pub. Date: Mar. 23, 2006

(65) Prior Publication Data

US 2007/0148017 A1 Jun. 28, 2007

(30) Foreign Application Priority Data

Sep. 17, 2004 (CN) ..... 2004 1 0050431

(51) Int. Cl.
*F04B 35/04* (2006.01)
*F04B 17/04* (2006.01)

(52) U.S. Cl. ..... 417/417; 166/66.4

(58) Field of Classification Search ..... 417/56, 417/415, 416, 555.1, 417; 166/66.4, 66.5
See application file for complete search history.

(56) References Cited

U.S. PATENT DOCUMENTS

| | | | | |
|---|---|---|---|---|
| 3,031,970 | A * | 5/1962 | Hoblitzelle | 417/417 |
| 4,687,054 | A * | 8/1987 | Russell et al. | 166/66.4 |
| 4,815,949 | A * | 3/1989 | Rabson | 417/417 |
| 5,252,043 | A * | 10/1993 | Bolding et al. | 417/417 |
| 5,831,353 | A * | 11/1998 | Bolding et al. | 310/12 |
| 6,203,288 | B1 * | 3/2001 | Kottke | 417/328 |
| 7,316,270 | B2 * | 1/2008 | Shen | 166/105 |

FOREIGN PATENT DOCUMENTS

| | | |
|---|---|---|
| CN | 2623872 | 7/2002 |
| CN | 1415858 | 5/2003 |
| CN | 2555422 | 6/2003 |
| CN | 2599279 | 1/2004 |

* cited by examiner

*Primary Examiner*—Devon C Kramer
*Assistant Examiner*—Peter J Bertheaud
(74) *Attorney, Agent, or Firm*—Smith, Gambrell & Russell, LLP

(57) ABSTRACT

A deep well pump, especially a numerically controlled reciprocating submersible pump with freely adjustable parameters, includes a balancing sieve tube, a drive and a pump. The drive includes a stator with airtight cavity and reciprocating head with iron cores inside the stator. The stator and the reciprocating head form a friction couple via supporting guides and the reciprocating head iron cores. The stator's upper end is connected to the pump's lower end through the sieve tube. An oil tube is connected to the pump. The stator's lower end is connected to the balancing sieve tube, end plug and end coupler serially.

16 Claims, 5 Drawing Sheets

NUMERICALLY CONTROLLED RECIPROCATING SUBMERSIBLE PUMP APPARATUS

TECHNICAL FIELD

This invention relates to a new kind of deep well oil extraction pump system, particularly to a numerically controlled reciprocating submersible pump apparatus having a drive integrated with a pump adjusting parameters online freely.

BACKGROUND OF THE INVENTION

The current oil extraction system worldwide consists of a nodding donkey, sucker and polish rods and a pump. The nodding donkey is the overground drive for the submersible pump in a borehole. The rods connect the head to the pump located thousands of meters underground. The reciprocating pump plunger lifts oil to the earth's surface. The current pump system has a series of disadvantages: 1) Large size and high cost. 2) Inefficiency. Most of the power is consumed by the thousand-meter-long rods' reciprocation. Only a small portion of the power is used for lifting petroleum-water mixture. 3) It is very hard for the reciprocating rods to always keep parallel to the oil tube center line, often resulting in rod breakage due to friction. A hole in the pump cylinder may even be worn by friction. 4) The only way to increase strength of the superlong rod is to increase rod section, resulting in heavier rod deadweight further. So current well depth is limited to 2400 meters. 5) The current oil extraction system, especially the superlong rods, not only needs larger investment, but also needs more operating time and cost. Further more, rod extension of 0.6 meter in one thousand meters decreases stroke and affects pump efficiency. 6) Residue in the petroleum-water mixture can only deposit on the plunger top. This may stop the pump during plunger's up stroke. 7) In poor oil wells, pump plunger's no-load operation leads to dry friction between the plunger and the pump cylinder, wasting energy and annealing the plunger and the pump cylinder. 8) Usually, natural gas is present in oil wells. The plunger's down stroke is made by gravity. Compressed natural gas prevents the plunger from reaching its dead end. Resultant "gas lock" affects normal oil extraction operation. Gas discharge has to be made if serious. 9) Sometimes, especially in old, low-production wells without enough liquid, current oil extraction system can only work intermittently (extraction parameters can be adjusted in limited extent). If the pump stops, restarting is very difficult or in some cases even impossible. So all rods and pump have to be drawn to the ground and then put them down again in the oil well.

SUMMARY OF THE INVENTION

The purpose of the invention is to provide the numerically controlled reciprocating submersible pump apparatus. This apparatus is a combination of a drive and a pump that can freely adjust parameters online any time, eliminating the nodding donkey and rods, decreasing operating time and cost, saving large amount of investment, avoiding above disadvantages and using less power.

The invention's purposes are achieved through the following technique: A balancing tube, a drive and a pump are all placed in the oil-bearing stratum in an oil well. The drive consists of a stator with an airtight cavity and a reciprocating head with iron cores inside the stator. The stator and the reciprocating head form a friction couple via the stator's supporting guides and the reciprocating head's iron cores.

The stator's upper end is connected to the pump's lower end through a sieve tube. The pump has an oil tube. The stator's lower end is connected to the balancing sieve tube, end plug and end coupler serially.

There are groups of circular iron core windings inside the stator frame with supporting guides between winding groups. The iron cores and windings are arranged next to each other. On the inside surfaces of the circular windings there are seal bushings connected to the endcovers. All above mentioned together with the stator frame and iron cores form the airtight cavity. The stator iron core windings are wound radially and arranged axially. The supporting guides are made from alloy with smaller inside diameter than the seal bushings. The reciprocating head consists of a solid shaft with circular iron cores around it and permanent magnets equally spaced between the iron cores. The circular iron cores' outside surfaces are made from alloy. The permanent magnets have a smaller outside diameter than the circular iron cores. The stator's supporting guides and the iron cores' outside surfaces of the reciprocating head form a friction couple via the carbide layers on the inside surfaces of the stator supporting guides and the carbide layers on the outside surfaces of the reciprocating head iron cores. There is a pump housing outside the pump cylinder. Residue deposits in the circular space formed between the pump housing and the pump cylinder. A push rod goes through the sieve tube and connects with the upper end of the reciprocating head's shaft. The oil tube leads to the earth's surface. Windings' terminal from the stator is connected to the overground numerical control unit.

Basic Concept:

Making the drive reciprocate in line with the reciprocating pump plunger and making the drive directly drive the pump plunger to suck and lift oil. This is a revolutionized pump system powered through a cable, eliminating the overground electric motor, nodding donkey and underground mechanical transmission, reducing power consumption greatly.

The Invention has a Series of Advantages:

1. The invention makes the drive reciprocate in line with the reciprocating pump plunger and drives the pump plunger directly to suck and lift oil. It eliminates the overground electric motor, nodding donkey, other equipment and underground mechanical transmission. It is a new kind of oil extraction pump apparatus getting power through a cable.

2. The invention puts the drive and the pump together, freely adjusting working parameters online any time. It keeps operation even when the oil-water mixture is insufficient. Parameters can be adjusted freely any time at the overground numerical control unit, reducing amount of work in adjusting and changing pumps.

3. The invention places high-power, small diameter, heat resistant and corrosion resistant drive thousands of meters deep in the oil well, eliminating the nodding donkey and rods, saving ground space and large investment-equipment investment, daily maintenance, operating cost of changing broken rods, wear caused by eccentric rubbing, for example. It also reduces installation time and cost.

4. The drive's stator employs supporting guides. The reciprocating head has wear resistant, corrosion resistant alloy surfaces protecting the iron cores. The stator's supporting guides and the reciprocating head's alloy surfaces form a friction couple, increasing the drive's life greatly.

5. The invention uses no rods. So there is no eccentric wear between the rod and the oil tube and consequent short life, big dead load and power consumption. The drive directly connects with the pump plunger, making it reciprocate to lift oil, greatly reducing energy consumption during load transfer by 50% compared to the traditional method for producing the same amount of oil-water mixture.

6, The invention puts the drive directly in the oil-bearing stratum. It has the ability to withstand high temperatures, oil and high voltage etc.

DETAILED DESCRIPTION OF THE INVENTION

Figure 1:
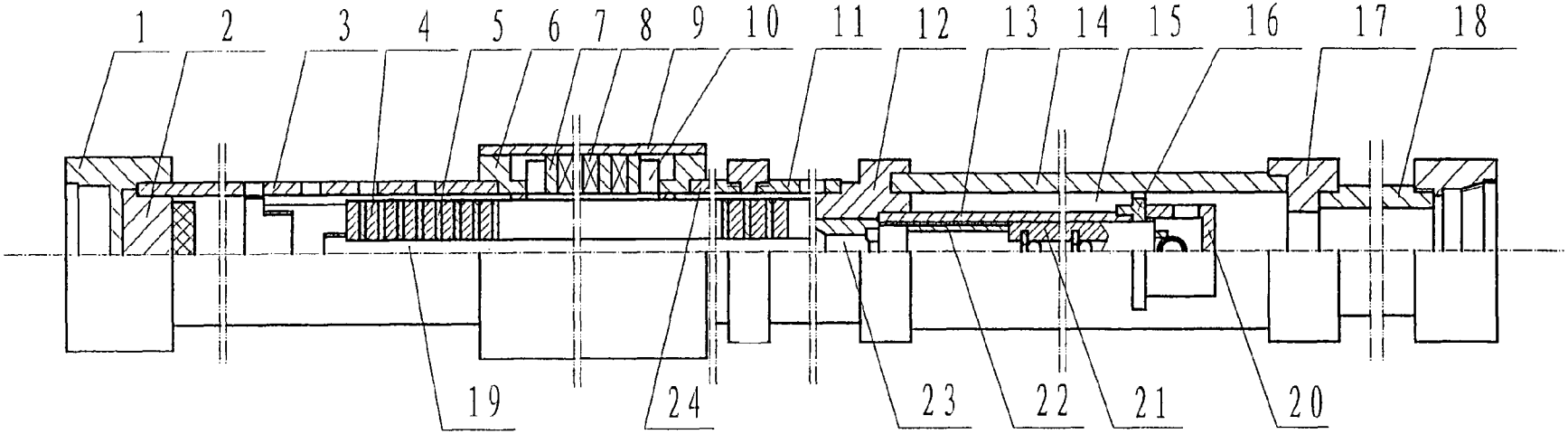
FIG. 1 is structure of this invention.

The invention, comprising a balancing sieve tube, a drive and a pump, is placed in the underground oil reservoir. See FIG. 1. The drive consists of a stator and a reciprocating head located in the stator. The upper end of the stator frame 9 is connected to one end of a sieve tube 11 through a coupler 6 with stepped recess 24 and the other end of the sieve tube 11 is connected to the oil tube via the pump. The lower end of the stator frame 9 is connected to the balancing sieve tube 3 through the coupler 6. The lower end of the balancing sieve tube 3 is connected to the end plug 2 and the end coupler 1. The oil tube 18 goes up to the surface.

Figure 2:
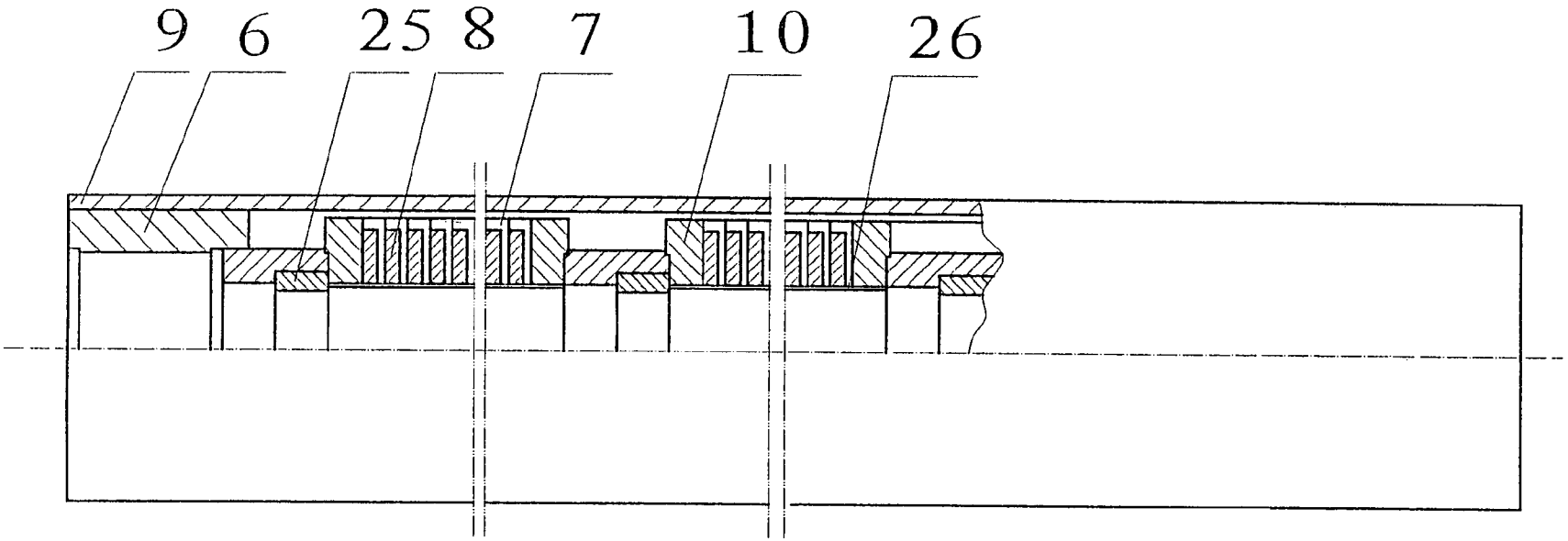
FIG. 2 is stator of this invention.

For details see FIGS. 1 and 2. The stator frame 9, groups of iron core windings and the supporting guides 25 form a circular cavity. There are a number of iron core windings inside the stator frame 9 with supporting guides 25 (made of alloy. The inside surfaces have carbide layers smaller in diameter) between the windings. A group of iron core windings is made up of iron cores 7, windings 8, endcovers 10 and seal bushings 26. A number of iron cores 7 arranged next to each other form a circular structure. There are a number of circular windings 8 inside the iron cores 7. The windings 8 are wound radially and arranged axially. There is an endcover 10 at the group's each end. A seal bushing 26 is connected with the endcover 10. They, together with the stator frame 9 and the circular iron cores 7 form the stator's airtight cavity filled with insulating oil. The winding 8 inside the stator is connected to the overground numerical control unit through a cable.

Figure 3:
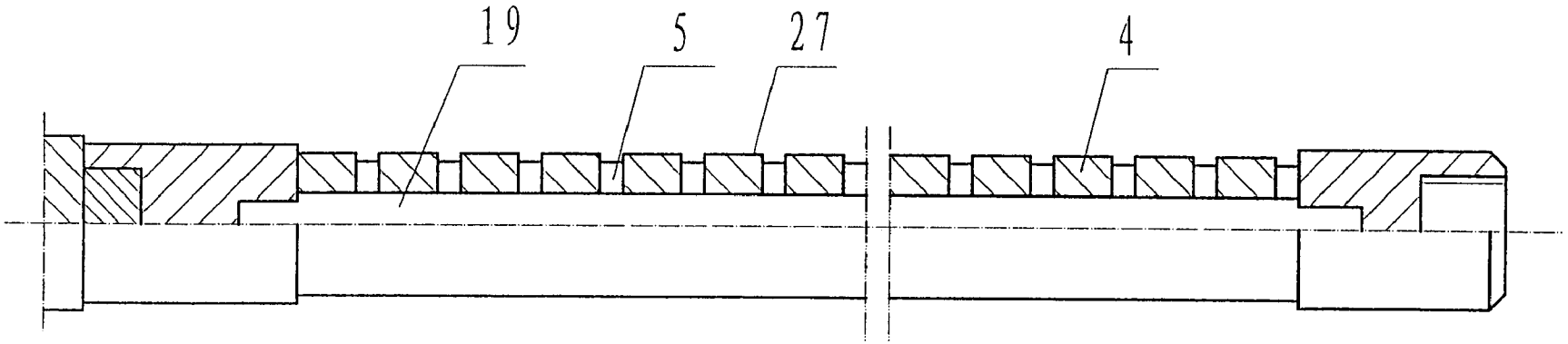
FIG. 3 is reciprocating head of this invention.

The reciprocating head consists of the shaft 19, iron cores 4, permanent magnets 5 and alloy layers 27. See FIGS. 1 and 3. The solid shaft 19 driven by the drive is circled by circular iron cores 4. There are permanent magnets between the iron cores (equally spaced, the magnets have a smaller outside diameter than the iron cores). The circular iron cores' outside surfaces are made of wear resistant and corrosion resistant alloy 27. These iron cores and the stator supporting guides 25 form a friction couple via the carbide layers on the inside surfaces of the supporting guides. The circular iron cores 4 have a larger outside diameter than the permanent magnets 5. The stator supporting guides 25 have a smaller inside diameter than the seal bushings.

Figure 4:
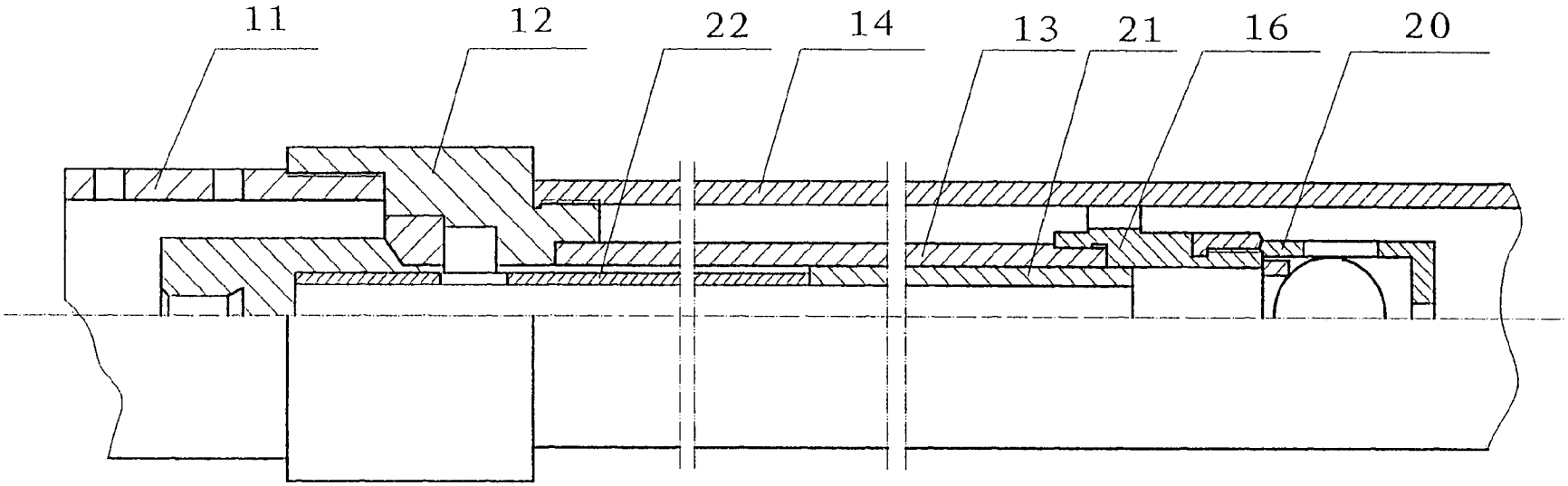
FIG. 4 is pump of this invention.

The pump is designed on the basis of the traditional pump. See FIGS. 1 and 4. There is a pump housing 14 outside the pump cylinder 13. The pump housing 14 is connected to the pump cylinder 13 through the adapter 12 and the positioner 16. A circular space 15 is formed between the pump housing 14 and the pump cylinder 13 for sand depositions. The upper end of the pump housing 14 is connected to the oil tube 18 through a threaded coupler 17. The lower end of the pump housing 14 is connected to the sieve tube 11 through the adaptor 12. The plunger assembly 21 inside the pump cylinder 13 is connected to the upper end of the plunger push rod 22. The push rod 22, going through the sieve tube, is connected to the upper end of the reciprocating head shaft 19 through the push rod coupler 23. The plunger assembly 21 is made up of a valve seat and a ball. The upper end of the plunger assembly 21, i.e. the upper end of the pump cylinder 13, is connected to a fixed valve 20, which is made up of a valve seat, a ball and a fixed valve cover.

Installation is done by connecting the stator windings to the overground numerical control unit. According to the required amount of oil-water mixture, parameters are programmed at the overground numerical control unit and electricity is supplied accordingly to make the stator generate an alternating magnetic field. The stator magnetic field and the reciprocating head's magnetic field produce electromagnetic driving force, making the reciprocating head move up and down. The plunger, which is directly connected to and driven by the reciprocating head, reciprocates at given speeds and strokes. The pump draws oil-water mixture through the sieve tube. The reciprocating plunger keeps lifting oil-water mixture to the surface.

The numerical control unit comprises three basic parts: a drive power, an inspection and control circuit and an indicating circuit. See FIG. 5.

The drive power (located in the upper part of FIG. 5) is made up of an AC/DC circuit and a DC/AC circuit. Wherein the first to sixth rectifiers D1 to D6 form a 3-phase all wave rectifying circuit turning 50 Hz alternating current into direct current, sending output signal to switch tubes G1 to G6 to form an inversion circuit producing alternating current with changeable frequencies.

Figure 5:
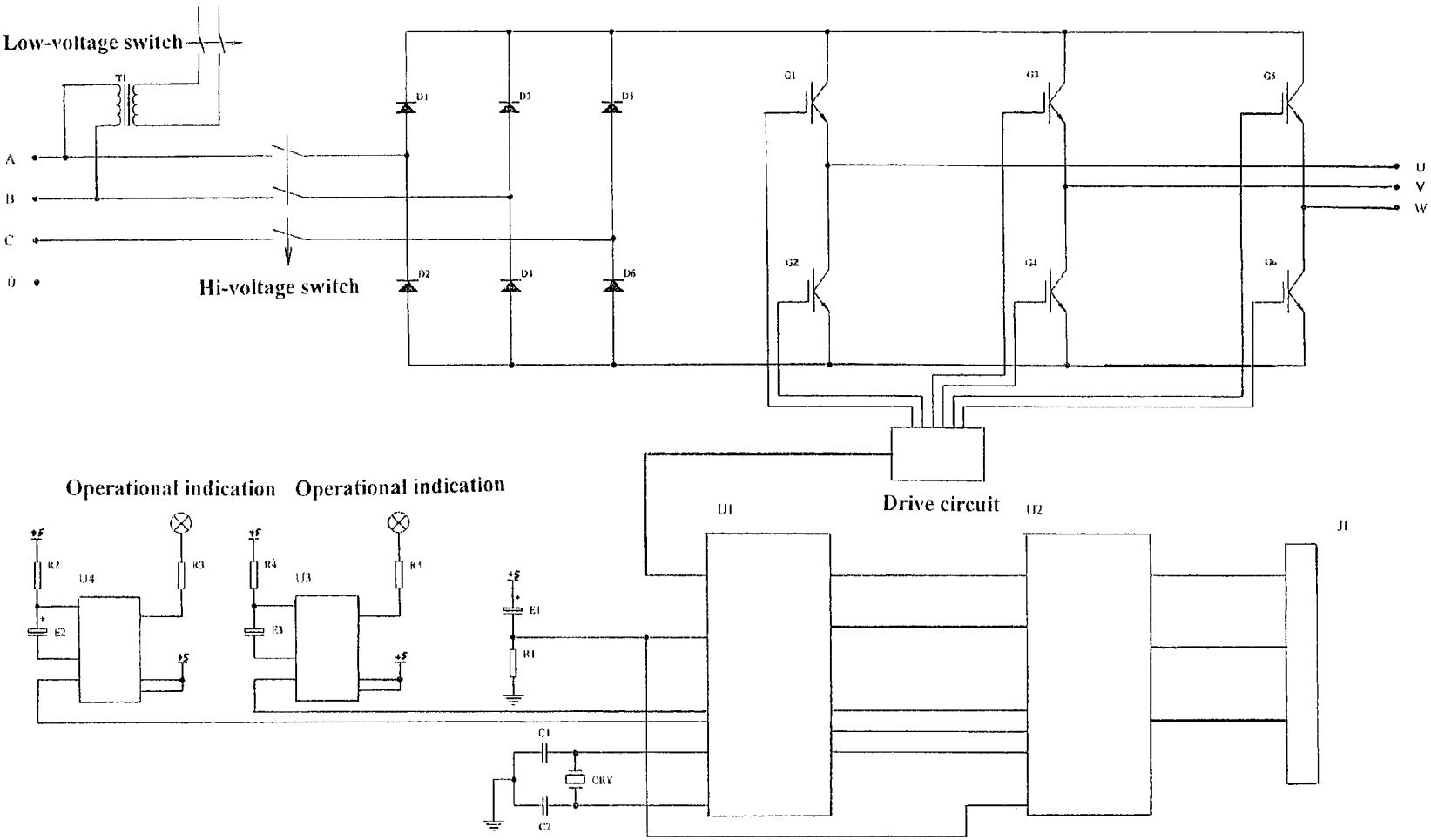
FIG. 5 is numerical control circuit.

The inspection circuit and the indicating circuit are in the lower part of FIG. 5. A micro processor U1 is their control center, firstly producing drive signal sent to switch tubes G1 to G6 through a drive circuit to form an inversion circuit, making the 6 switch tubes open and close at given intervals to guarantee that 3-phase alternating current with specified frequency is obtained at the output end. Secondly the micro processor U1 is connected to a slide switch J1 through an expanded interface U2 to adjust the drive's working parameters, such as up and down speeds and strokes online by selecting the position number on the switch J1. The micro processor U1 is also connected to the indicating circuits respectively made up of number 1 monostable trigger U 3 and number 2 monostable trigger U 4, sending command signals for all conditions any time. The invention is replacing the traditional oil extraction method which has a nodding donkey above ground. Placed in the oil well in an oil reservoir, the invention lifts oil-water mixture directly to overground pipeline with the following features:

1, The numerically controlled reciprocating submersible pump apparatus connects its drive's reciprocating head with the pump plunger directly. It gets power through a cable. The drive directly makes the pump plunger reciprocate for sucking. It saves energy for no use of reduction and reversing gear mechanism and powered intermittently.

2. The numerically controlled reciprocating submersible pump apparatus produces heat during operation in oil-bearing strata, heating and diluting surrounding oil to ease extraction.

3. The numerically controlled reciprocating submersible pump apparatus uses strong magnets, producing alternating magnetic field by using electricity, preventing deposition of paraffin wax.

4. The numerically controlled reciprocating submersible pump apparatus's vibration produced by reciprocating motions in oil-bearing strata makes the liquid move faster and increases the supply of oil-water mixture.

The Invention Also has Advantages:

1. Eliminates the nodding donkey and keeps daily maintenance and repair down.

2. Less space requirement.

3. New technology solution for inclined wells which are difficult to extract oil.

4. Saves energy. The traditional method uses a 37 kw motor working 24 hours/day. For producing the same amount of oil-water mixture, the invention saves energy by over ⅓ at work and increases liquid production by over ⅓ at the same time.

5. State of the art control. Online automatically data collection, analysis, commanding and adjusting.

What is claimed is:

1. A reciprocating submersible pump apparatus, comprising:

a pump having a pump housing and an internal, adjustable pump component within the pump housing;

a sieve tube to which is connected said pump;

a balance sieve tube;

a stator device comprising a stator housing in which is positioned a combination stacked sequence of (a) a first spacer and guide device, (b) a winding combination of opposite end covers and intermediate sequenced core components and windings, each in a direct contact stack arrangement, and (c) a second spacer and guide device;

first and second couplers positioned at opposite ends of said stator housing with said first coupler being positioned for coupling of said stator device to said sieve tube and said second coupler being positioned for coupling of said stator device to said balance sieve tube; and a reciprocating head positioned within said stator device and drivingly connected to the adjustable pump component as to provide for the pumping of an underground fluid.

2. The reciprocating submersible pump apparatus of claim 1 wherein said first spacer and guide device comprises a sleeve and an annular guide.

3. The reciprocating submersible pump apparatus of claim 2 wherein said annular guide is nested in an annular groove of said sleeve and has an internal surface of an alloy material.

4. The reciprocating submersible pump apparatus of claim 3 wherein said internal surface is a sintered iron material.

5. The reciprocating submersible pump apparatus of claim 2 wherein said reciprocating head comprises a plurality of core members and magnet components arranged in series, and with said core members having an exterior surface of an alloy material that is designed for friction contact with an alloy internal surface of said annular guide.

6. The reciprocating submersible pump apparatus of claim 2 wherein said first coupler is in direct stack contact with the sleeve of said first spacer and guide device.

7. The reciprocating submersible pump apparatus of claim 1 wherein said first coupler is in direct stack contact with said first spacer and guide device.

8. The reciprocating submersible pump apparatus of claim 1 wherein said stator housing and combination stacked sequence provides a sealed stator device suitable for deep well functioning.

9. The reciprocating submersible pump apparatus of claim 8 wherein said sealed stator device is provided internally with an insulating oil.

10. The reciprocating submersible pump apparatus of claim 1 wherein said pump includes an internal cylinder within said pump housing and said moving pump component includes a plunger assembly in driving engagement with said reciprocating head.

11. The reciprocating submersible pump apparatus of claim 10 wherein between said internal cylinder and said pump housing is provided a debris deposit clearance space, and wherein said stator housing has an exterior surface positioned radially external to an exterior surface of said pump housing.

12. The reciprocating submersible pump apparatus of claim 1 wherein said balance sieve tube comprises a plurality of sets of sieve holes, and said sets being spaced along an axis of elongation of said balance sieve tube.

13. A reciprocating submersible pump apparatus, comprising:

a pump having a pump housing and an internal, adjustable pump component within the pump housing;

a sieve tube to which is connected said pump;

a balance sieve tube;

a sealed stator device comprising a stator housing in which is positioned a combination stacked sequence of (a) a first spacer and guide device, (b) a winding combination of opposite end covers and intermediate sequenced core components and winding components each in a direct contact stack arrangement, and (c) a second spacer and guide device;

wherein said stator device is placed in a stacked arrangement relative to said sieve and balance tube such that an exterior portion of said stator device is radially external to a radially external surface of each of said sieve tube and balance sieve tube, and an interior surface of said stator device is positioned radially inward of an interior surface of each of said sieve tube and balance sieve tube relative to respective coupling regions of said stator device to said sieve tube and balance sieve tube; and a reciprocating head positioned within said stator device and drivingly connected to the adjustable pump component as to provide for fluid pumping in a submersible setting.

14. The reciprocating submersible pump apparatus of claim 13 further comprising a first coupler for coupling said stator device to said balance sieve tube and a second coupler for coupling said stator device to said sieve tube and said first coupler being in direct contact and in a stack relationship with said first spacer and guide device and said second coupler being in direct contact and in a stack relationship with said second spacer and guide device.

15. The reciprocating submersible pump apparatus of claim 14 wherein said first and second couplers define stepped recesses for receiving respective ends of the balance sieve tube and sieve tube.

16. The reciprocating submersible pump apparatus of claim 13 wherein said reciprocating head comprises core rings and magnetic rings in series with the core rings having a larger diameter than the magnetic rings and an alloy layer exterior surface, and said first and second spacer and guide devices each feature a spacer with an annular recess as well as a guide device with an alloy layer interior surface, with the guide device being received within the annular recess as to have the alloy layer interior surface extend into guiding friction contact with the alloy layer exterior surface of said core rings of said reciprocating head.

* * * * *